US009283596B2

(12) United States Patent
Schwab et al.

(10) Patent No.: US 9,283,596 B2
(45) Date of Patent: Mar. 15, 2016

(54) HIGH-PRESSURE CLEANING APPLIANCE

(75) Inventors: Werner Schwab, Rudersberg (DE); Peter Pfaff, Aichwald (DE)

(73) Assignee: Alfred Kaercher GmbH & Co. KG, Winnenden (DE)

( * ) Notice: Subject to any disclaimer, the term of this patent is extended or adjusted under 35 U.S.C. 154(b) by 963 days.

(21) Appl. No.: 13/434,978

(22) Filed: Mar. 30, 2012

(65) Prior Publication Data

US 2013/0074884 A1 Mar. 28, 2013

Related U.S. Application Data

(63) Continuation of application No. PCT/EP2009/063434, filed on Oct. 14, 2009.

(51) Int. Cl.

| | |
|---|---|
| ***B08B 3/00*** | (2006.01) |
| ***B08B 3/10*** | (2006.01) |
| ***B08B 3/02*** | (2006.01) |

(52) U.S. Cl.

CPC . *B08B 3/10* (2013.01); *B08B 3/026* (2013.01); *B08B 2203/007* (2013.01); *B08B 2203/0211* (2013.01); *B08B 2203/0235* (2013.01)

(58) Field of Classification Search

CPC ..... B08B 3/026; B08B 2203/007; B08B 2203/0211; B08B 2203/0276; B08B 2203/0235

USPC ..... 134/105, 22.12, 18, 22.18, 47, 88, 94.1; 137/334, 335, 341; 239/412, 428.5, 239/722

See application file for complete search history.

(56) References Cited

U.S. PATENT DOCUMENTS

| | | | | |
|---|---|---|---|---|
| 3,477,688 A | | 11/1969 | Cruse | |
| 5,245,714 A | * | 9/1993 | Haraga | A61H 33/02 134/22.12 |
| 5,411,421 A | | 5/1995 | McCardell, Jr. | |

(Continued)

FOREIGN PATENT DOCUMENTS

| | | | | |
|---|---|---|---|---|
| DE | 36 17 556 | | 12/1987 | |
| DE | 9303648 | * | 3/1993 | B05B 7/208 |

(Continued)

OTHER PUBLICATIONS

Zenz et al., Mar. 1993, DE 9303648, Machine Translation.*

(Continued)

*Primary Examiner* — Michael Barr
*Assistant Examiner* — Thomas Bucci
(74) *Attorney, Agent, or Firm* — Lipsitz & McAllister, LLC

(57) ABSTRACT

The invention relates to a high-pressure cleaning appliance, comprising a heatable heat exchanger for heating a liquid that is dischargeable by the high-pressure cleaning appliance, a motor having a drive shaft that defines a drive axis, a pump unit for increasing the liquid pressure, a blower wheel for generating a combustion air flow, and a fuel pump for delivering a fuel to the heat exchanger, wherein the pump unit, the blower wheel, and the fuel pump are disposed along the drive axis and are drivable by means of the drive shaft and form an assembly together with the motor. In order to fit the assembly to the appliance in a simplified manner while achieving a more compact design for appliance, the appliance comprises a half-shell housing having a first half-shell and a second half-shell which between them define an accommodating chamber in which the assembly is at least partially accommodated.

20 Claims, 7 Drawing Sheets

(56) References Cited

U.S. PATENT DOCUMENTS

| | | | |
|---|---|---|---|
| 6,695,235 | B2 | 2/2004 | Faller et al. |
| 2003/0080222 | A1 | 5/2003 | Faller et al. |
| 2008/0128032 | A1 | 6/2008 | Lapetina et al. |

FOREIGN PATENT DOCUMENTS

| | | | | |
|---|---|---|---|---|
| DE | 9303648 | U1 * | 6/1993 | ..... B05B 7/208 |
| DE | 93 03 648 | | 8/1993 | |
| DE | 44 45 521 | | 12/1995 | |
| DE | 196 07 882 | | 2/1997 | |
| EP | 0 890 394 | | 1/1999 | |
| EP | 0890394 | A2 * | 1/1999 | ..... B08B 3/026 |
| WO | WO 2008/030799 | | 3/2008 | |

OTHER PUBLICATIONS

Rolf et al., "High Pressure Cleaning Device" Jan. 1999, EP 0890394—Machine Translation.*

* cited by examiner

HIGH-PRESSURE CLEANING APPLIANCE

This application is a continuation of international application number PCT/EP2009/063434 filed on Oct. 14, 2009.

The present disclosure relates to the subject matter disclosed in international application number PCT/EP2009/063434 of Oct. 14, 2009, which is incorporated herein by reference in its entirety and for all purposes.

BACKGROUND OF THE INVENTION

1. Field of the Invention

The invention relates to a high-pressure cleaning appliance, comprising a heatable heat exchanger for heating a liquid that can be discharged by the high-pressure cleaning appliance, a motor having a drive shaft that defines a drive axis, a pump unit for increasing the liquid pressure, a blower wheel for generating a combustion air flow, and a fuel pump for delivering a fuel to the heat exchanger, wherein the pump unit, the blower wheel, and the fuel pump are disposed along the drive axis and can be driven by means of the drive shaft and form an assembly together with the motor.

2. Description of Related Art

Such a high-pressure cleaning appliance is described in DE 36 17 556 A1. It has a complicated construction, the assembly being mounted with a vertical drive axis and in an upright position in such a manner on a wall of a blower wheel housing, which is configured in a complicated manner, that it can oscillate and wobble, and the fuel pump is held on a chassis of the high-pressure cleaning appliance. That portion of the assembly consisting of motor and pump unit that is disposed above the wall is freely accessible in the interior formed beneath the hood of the high-pressure cleaning appliance.

It is an object of the present invention to improve a high-pressure cleaning appliance of the aforementioned kind in such a manner that the assembly can be fitted to the high-pressure cleaning appliance in a simplified manner while achieving a more compact design for the high-pressure cleaning appliance.

BRIEF SUMMARY OF THE INVENTION

This object is achieved according to the invention for a high-pressure cleaning appliance of the generic kind in that the high-pressure cleaning appliance comprises a half-shell housing having a first half-shell and a second half-shell which between them define an accommodating chamber in which the assembly is at least partially accommodated.

By using the half-shell housing for fitting the assembly on the high-pressure cleaning appliance, fasteners otherwise required for mounting individual components of the assembly can be at least partially saved. On the one hand, this saving results in a reduced space requirement and thereby facilitates a more compact design of the high-pressure cleaning appliance. On the other hand, less effort is required for fitting the assembly on the high-pressure cleaning appliance. In addition to the saving of fasteners, the simplified fitting achieved in this manner serves for reducing the production cost for the high-pressure cleaning appliance. Moreover, maintaining the high-pressure cleaning appliance is simplified.

The assembly is at least partially accommodated in the accommodating chamber. This is possible, for example, by the assembly being placed into the first half-shell and being subsequently at least partially covered by the second half-shell. For example, projections which interact with corresponding recesses on the half-shell housing for fixing the assembly relative to the half-shell housing can be disposed on the assembly. The projections may involve pins which are molded on the motor and correspond with blind-hole-like recesses on the half-shell housing. Additionally or as an alternative to this positive-locking fixation, the assembly can be held on the half-shell housing in a force-locking manner.

In addition to the advantages already mentioned, the assembly of the high-pressure cleaning appliance according to the invention is partially accommodated in the accommodating chamber and thus at least partially covered by the first and/or second half-shell. Thereby, the possibility is given to protect the part of the assembly accommodated in the accommodating chamber against external influences and to deprive a user of direct access thereto.

It is beneficial if the high-pressure cleaning appliance comprises, as a component part of the assembly, a fan that is disposed along the drive axis and can be driven by the drive shaft for generating a cooling air flow that cools the motor. In this manner, the motor can be cooled effectively and protected against potential overheating. The fan is a component part of the assembly and can be driven by the drive shaft so that a separate drive for the fan can be avoided. This enables a design of the high-pressure cleaning appliance that is still very compact.

An effective cooling of the motor can be achieved if the fan is formed as an axial fan that is held on the drive shaft and, with regard to the drive axis, is located upstream of the motor. Here, it is preferably located immediately upstream of the motor.

It is of advantage if the fan and the motor are at least partially disposed in the accommodating chamber. In this manner, the fan and the motor are at least partially protected against external influences and direct access by a user. At the same time, cooling of the motor even with a compact construction of the half-shell housing can be ensured in that the fan generates a cooling air flow in the drive chamber.

It is advantageous if, in the region of the fan and the motor, the half-shell housing forms a flow channel and if, in the half-shell housing, at least one inlet opening for air sucked in by the fan is formed axially upstream of the fan with regard to the drive axis, and at least one outlet opening for the cooling air flow is formed axially downstream of the fan. In this manner, a particularly effective cooling of the motor can be achieved wherein the fan sucks cooling air through the at least one inlet opening and blows it through the flow channel and past the motor. The cooling air can exit the half-shell housing through the at least one outlet opening. The first and/or the second half-shell serve in this embodiment as air duct elements of the flow channel, wherein said duct elements can in particular be formed in such a manner that the half-shell housing follows an outer contour of the motor. In this manner, the cooling air flow can flow effectively around the motor and cool the same.

It can be provided that atmospheric cooling air is at least partially sucked through the at least one inlet opening and that the cooling air passing through the at least one outlet opening can be discharged at least partially into the atmosphere.

Advantageously, the pump unit is at least partially disposed outside of the half-shell housing. In this manner, access to the pump unit is made easier. This is of advantage, for example, during maintenance of the high-pressure cleaning appliance, for instance if maintenance work is to be carried out on a supply conduit for liquid to be pressurized and/or on a discharge conduit for pressurized liquid, which conduits are held on the pump unit.

In this embodiment, the pump unit can be disposed in particular with the portion of the unit that is disposed outside of the half-shell housing being in a half-chamber that is delimited by one of the half-shells which, in the region of the pump unit, with regard to the drive axis, extends axially beyond the other half-shell.

Likewise, in order to simplify the maintenance of the pump unit, it is of advantage if, in the axial direction with regard to the drive axis, the pump unit forms a first end of the assembly.

Preferably, in the axial direction with regard to the drive axis, the pump unit is disposed on the side of the motor that faces away from the aforementioned fan. This allows not only the motor to be cooled by means of the cooling air flow, but also the pump unit.

Advantageously, the motor and the pump unit form a unit which, with regard to the drive axis, engages through an opening of the half-shell housing formed between the first half-shell and the second half-shell. The pump can for example be flanged to the motor, and is, in this embodiment, at least partially disposed outside the accommodating chamber.

Preferably, the blower wheel is disposed in the accommodating chamber. In this way, the half-shell housing together with the blower wheel can form portions of a blower for combustion air. In this manner, a separate housing for the blower wheel can be avoided. In addition to achieving a compact design, this enables a saving of components and therefore allows cost-effective production of the high-pressure cleaning appliance. Moreover, with said half-shell housing, an air duct for the combustion air can be achieved.

By means of the blower formed in this manner by the blower wheel and the half-shell housing, an effective combustion air flow can be provided if, in the half-shell housing, at least one inlet opening for air sucked in by the blower wheel is formed axially upstream of the blower wheel with regard to the drive axis, and/or if, in the half-shell housing, at least one outlet opening is formed for the combustion air flow.

It can be provided that atmospheric air can be at least partially sucked through the inlet opening by the blower wheel so that not exclusively air heated by the waste heat of the motor is fed to the heat exchanger.

Advantageously, the half-shell housing forms a connecting element for a combustion air channel which, via the outlet opening, opens out into the accommodating chamber. The connecting element is configured, for example, in the form of a connection pipe which can be connected to a combustion air channel such that it is, in particular, detachable without tools. This makes assembling and maintenance of the high-pressure cleaning appliance easier.

Preferably, the blower wheel is formed as a radial fan held on the drive shaft and is disposed, in the axial direction with regard to the drive axis, on the side, facing away from the motor, of a fan associated with the motor. In this manner, a combustion air flow can be effectively provided by the blower wheel. Because the blower wheel is located axially upstream of the fan and the motor, this embodiment can ensure that the combustion air does not exclusively comprise air that is heated by the waste heat of the motor. In practice, this was found to be more advantageous for the operation of the heat exchanger.

It is beneficial if, between the blower wheel and the fan, in the axial direction with regard to the drive axis, an intermediate space is formed which is delimited in the circumferential direction of the drive axis by the half-shell housing and into which air sucked in by the fan can enter through a plurality of inlet openings formed in the half-shell housing in the circumferential direction of the drive axis. In this manner, on the one hand, it can be ensured that for forming the cooling air flow, a sufficient amount of air can be sucked in by the fan. On the other hand, by means of the blower wheel disposed axially upstream of the fan, a combustion air flow can be provided in an effective manner. In this embodiment, the half-shell housing can for example form a first housing portion which, together with the blower wheel, forms a blower. Furthermore, the half-shell housing can form a second housing portion which forms a flow channel that at least partially surrounds the fan and the motor. The two housing portions are connected to one another in the region of the intermediate space between the blower wheel and the fan, and air sucked in by the fan can enter via the inlet openings into the accommodating chamber. In this manner, the half-shell housing forms as it were two housing portions disposed axially one after the other for the blower and for the motor and the fan—in the form of the flow channel. Half of each housing portion is formed in each case by one of the half-shells.

Advantageously, an intermediate wall oriented transverse to the drive axis divides the accommodating chamber, with regard to the drive axis, axially into a first chamber region in which the combustion air flow can be generated and into a second chamber region in which a cooling air flow that cools the motor can be generated. The intermediate wall separates the accommodating chamber with regard to functionality. In the first chamber region, the combustion air flow is generated by means of the blower wheel. In the second chamber region, for example by means of the fan, the cooling air flow is generated. In this manner, the motor can be effectively cooled and, at the same time, combustion air can be provided for the heat exchanger. The intermediate wall is preferably disposed at or in the aforementioned intermediate space.

In a constructionally simple configuration of the high-pressure cleaning appliance, it is advantageous if the intermediate wall is formed by the blower wheel. The latter involves, for example, a radial fan which has a disk that is oriented transverse to the drive axis, and on the outer circumference of said disk, fan blades are held which are aligned parallel to the drive axis. Thus, a separate intermediate wall or an intermediate wall formed by the first and/or the second half-shell can be dispensed with.

Advantageously, the fuel pump is disposed outside of the half-shell housing because this makes maintaining the high-pressure cleaning appliance easier. The fuel pump is accessible outside the half-shell housing during maintenance in a simplified manner so that fuel conduits can be disconnected from the fuel pump and/or can be connected thereto in a more user-friendly manner.

It can be provided that the fuel pump is disposed in a half-chamber delimited by one of the half-shells which, in the region of the fuel pump, protrudes with regard to the drive axis axially beyond the other half-shell.

Likewise, in order to reach the fuel pump in a more simple manner and therefore to make maintenance of the high-pressure cleaning appliance easier, it is convenient if, in the axial direction with regard to the drive axis, the fuel pump forms a second end of the assembly.

It was found to be advantageous if the fuel pump is held on the drive shaft and, with regard to the drive axis, is located axially upstream of the blower wheel. However, the fuel pump can also be held on the blower wheel and thus coupled in a rotationally fixed manner to the drive shaft.

Preferably, the half-shell housing has a holding element which is aligned transverse to the drive axis and on which the fuel pump is held, with regard to the drive axis, in the axial and/or radial direction. Said holding element serves for fixing the fuel pump and therefore also the assembly relative to the half-shell housing, for example by positive locking.

Heretofore, the configuration of the half-shell housing and the first and the second half-shell has not yet been addressed in detail. Preferably, the half-shell housing is configured in a barrel-shaped manner and has an at least partially trough-shaped first half-shell and/or second half-shell. It was found that in the case of a barrel-shaped configuration of the half-shell, a particularly compact design can be achieved. In the barrel-shaped half-shell housing, the blower wheel, the fan, and the motor can for example be disposed at least partially in a space-saving manner wherein the "axis" of the half-shell housing is aligned coaxially with the drive axis. The half-shell housing can be disposed on the high-pressure cleaning appliance in such a manner that its "axis" is aligned horizontally, vertically, or in any other manner.

Advantageously, the first half-shell and/or the second half-shell are made as one piece and/or are made from a plastics material. Thereby, the high-pressure cleaning appliance is given a simple construction, and the production costs can be reduced. It is particularly advantageous if the first half-shell and the second half-shell are made in one piece, and if the first half-shell and the second half-shell are made from a plastics material.

Preferably, the high-pressure cleaning appliance comprises a chassis which forms the first half-shell and/or the second half-shell. Thereby, the construction of the high-pressure cleaning appliance can be further simplified, and its design can be made even more compact. Furthermore, this reduces the number of components required for the high-pressure cleaning appliance, and therefore the production costs of the same are reduced. The chassis can in particular be made in one piece and can be made from a plastics material. In a preferred embodiment, it was found to be advantageous if the chassis forms the first half-shell into which the assembly can be inserted for installation. Subsequently, the assembly can be covered at least partially by the second half-shell, which can be fixed to the first half-shell.

In order to achieve an even more compact design of the high-pressure cleaning appliance, it is of advantage if the drive axis is aligned horizontally.

For the same reason it has proven to be advantageous if the assembly, in particular with a horizontally aligned drive axis, is disposed below the heat exchanger.

BRIEF DESCRIPTION OF THE DRAWINGS

The following description of a preferred embodiment of the invention serves, in connection with the drawing, for a more detailed explanation of the invention. In the figures.

DETAILED DESCRIPTION OF THE DRAWINGS

Figure 1:
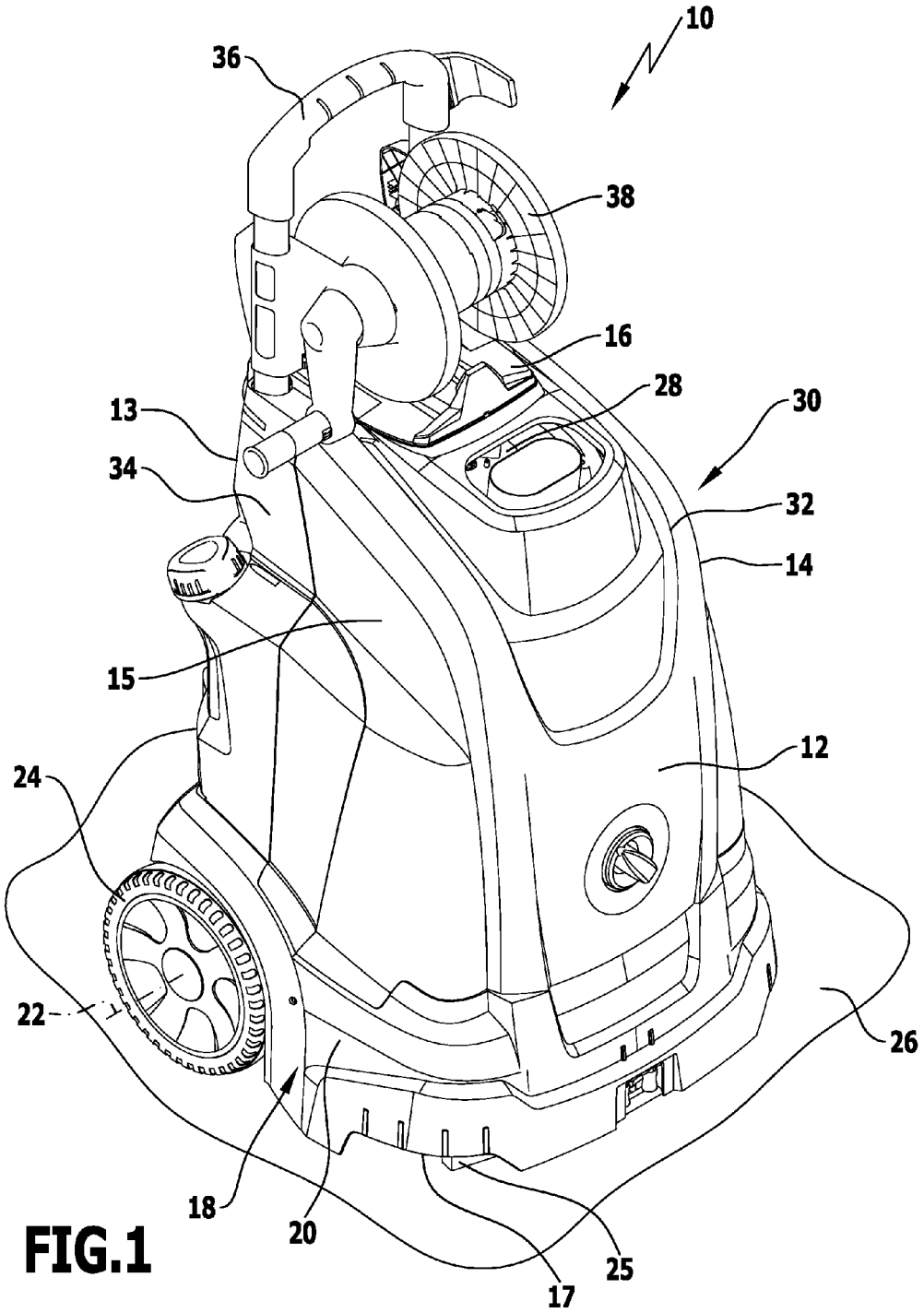
FIG. 1 shows a perspective view of a high-pressure cleaning appliance according to the invention.

A preferred embodiment of a high-pressure cleaning appliance according to the invention is illustrated in a perspective view in FIG. 1 and is designated there as a whole by the reference number 10. It has a front side 12, a rear side 13, a left side 14, a right side 15, an upper side 16, and a lower side 17.

The high-pressure cleaning appliance 10 comprises a bottom part 18 illustrated in the FIGS. 3 to 7, said bottom part comprising a chassis 20 on which, near the rear side 13 on the left side 14 and on the right side 15, two wheels 23 and 24 are held which are rotatable about a common axis 22 of rotation. Near the front side 12, the high-pressure cleaning appliance 10 has, on the lower side 17, a plurality of support elements of which only a support leg 25 is visible. With these support elements and the wheels 23 and 24, the high-pressure cleaning appliance 10 can stand on a set-down surface 26.

Above the bottom part 18, a heatable heat exchanger 28 is disposed in a non-illustrated manner standing in an upright position. In FIG. 1, the latter is illustrated only partially, hidden underneath a housing 30 of the high-pressure cleaning appliance 10. The housing 30 comprises a hood 32 in the region of the front side 12 and the portions of the left side 14 and right side 15 that face toward the front side 12. Furthermore, the housing 30 comprises a housing wall 34 in the region of the rear side 13 and the portions of the left side 14 and the right side 15 that face toward the rear side 13.

By means of a handle in the form of a hand grip 36, the high-pressure cleaning appliance 10 can be tilted about the contact points of the wheels 23 and 24 on the set-down surface 26 and thus can be moved on the set-down surface 26 in a manner similar to a sack truck.

A hose reel 38 held on the upper side 16 serves for accommodating a high-pressure hose, not illustrated in the drawing, which can be connected to the outlet of the heat exchanger 28.

Figure 2:
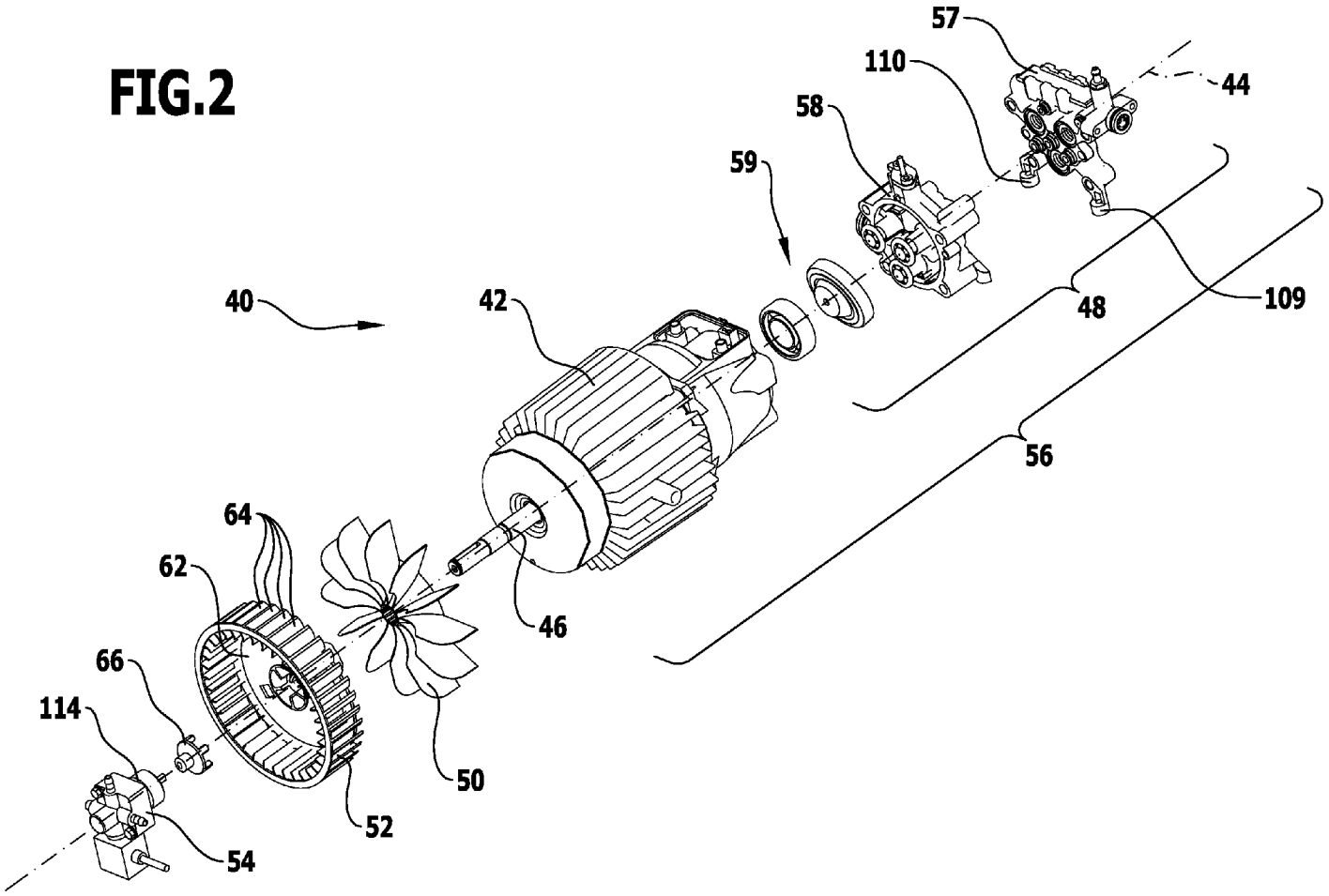
FIG. 2 shows a perspective view of an assembly of the high-pressure cleaning appliance of FIG. 1, comprising a motor, a pump unit, a fan, a blower wheel and a fuel pump, in an exploded view.

In order to pressurize, by means of the high-pressure cleaning appliance 10, a liquid, for example water, which is fed to the cleaning appliance and can be heated by means of the heatable heat exchanger 28, the high-pressure cleaning appliance 10 has an assembly 40 which is shown in FIG. 2 in an exploded view. Said assembly 40 comprises a motor 42 having a drive shaft 46 which defines a drive axis 44, a pump unit 48, a fan 50, a blower wheel 52 and a fuel pump 54. The motor 42 is configured as an electric motor and the pump unit 48 configured as an axial piston pump is flanged thereto so that the motor 42 and the pump unit 48 form a common unit 56.

The pump unit 48 forms, in the axial direction with regard to the drive axis 44, a first end of the assembly 40. For the formation as an axial piston pump, the pump unit 48 has a pump head 57, a pump block 58 and a swash plate arrangement 59 so that the pump unit 48 can be driven in a manner known per se by the drive shaft 46. Moreover, the drawing shows a supply conduit 60 for liquid to be pressurized and a connecting element 61 on the pump head 57 for a non-illustrated discharge conduit so as to supply pressurized liquid to the heat exchanger 28.

The fan 50 is held on the drive shaft 46 so that it can be driven by the drive shaft 46 and is located directly upstream of the motor 42 on the side of the motor 42 that faces away from the pump unit 48. It is formed as an axial fan.

Disposed upstream of the fan 50 in the direction of the drive axis 44 is the blower wheel 52 which is formed as a radial fan. It has the shape of a dish and comprises a carrier disk 62 oriented transverse to the drive axis 44. Held on said disk 62 in the circumferential direction of the drive axis 44 are fan blades 64 extending parallel to said drive axis 44. The blower wheel 52 is likewise held on the drive shaft 46 and can be driven by the same.

On the side of the blower wheel 52 facing away from the fan 50, the fuel pump 54 is coupled to the blower wheel 52 in a rotationally fixed manner by means of a coupling member 66 so that the fuel pump 54 also can be driven by the drive shaft 46. The fuel pump 54 forms, in the axial direction with regard to the drive axis 44, a second end of the assembly 40. By means of a first fuel conduit, which is not illustrated in the drawing, the fuel pump 54 can be connected to a container for fuel, not illustrated in the drawing, which is located on the right side 15 below the housing 30. By driving the fuel pump 54 by means of the drive shaft 46, fuel can be fed through a second fuel conduit, which is likewise not shown in the drawing, to the heat exchanger 28.

The above-described structure of the assembly 40, by which the pump unit 48, the fan 50, the blower wheel 52 and the fuel pump 54 can be driven by the drive shaft 46, enables a compact structure of the high-pressure cleaning appliance 10 in which the motor 42 can be employed as the only drive. Therefore, no space for an additional drive is necessary.

Furthermore, the manner, described below, as to how the assembly 40 is installed in the high-pressure cleaning appliance 10 facilitates the compact design of the same and simple assembling and simple maintenance of the cleaning appliance.

The chassis 20, which in terms of manufacturing is made in a simple and cost-effective manner in one piece from a plastics material, comprises, for accommodating the assembly 40, an elongated receptacle 70 which is oriented transverse to a longitudinal center axis 68 of the high-pressure cleaning appliance 10. Said receptacle 70 extends in the transverse direction of the high-pressure cleaning appliance 10 approximately between edges 71 and 72 formed by the chassis 20 on the left side 14 and the right side 15, respectively. In the longitudinal direction of the high-pressure cleaning appliance 10, the receptacle 70 is disposed approximately in the region of the middle of the cleaning appliance between the front side 12 and the rear side 13 (FIGS. 3 to 7).

A bottom wall 74 delimiting the receptacle 70 from beneath extends horizontally in some portions on its side facing toward the front side 12 and on the side facing toward the rear side 13, whereas approximately in the region of the middle of the high-pressure cleaning appliance 10, said bottom wall, with regard to the longitudinal direction of the cleaning appliance, is deepened toward the lower side 17. In a wall portion 76 which is narrow with regard to the total width of the high-pressure cleaning appliance 10 and is disposed near the edge 71, the bottom wall 74 runs horizontally. In a corresponding manner, the bottom wall 74 runs horizontally in a wall portion 78 which is narrow with regard to the width of the high-pressure cleaning appliance 10 and is disposed near the edge 72. Moreover, the wall portion 78 is provided with a plurality of through-openings 80.

Between the wall portions 76 and 78, the bottom wall 74 runs curved in the direction of the lower side 18. In this manner, the chassis 20 forms a trough 82 in the transverse direction of the high-pressure cleaning appliance 10.

A first trough portion 84 comprising a wall portion 86 of the bottom wall 74 adjoins the wall portion 76 and extends therefrom approximately up to three quarters of the distance of the edge 71 from the edge 72. In this manner, the first trough portion 84 takes approximately a length corresponding to half the width of the high-pressure cleaning appliance 10. At its end facing toward the wall portion 76, a multiplicity of through-openings 88 are disposed in its wall portion 86.

A second trough portion 90 adjoins the wall portion 78. It is deeper and is wider in the longitudinal direction of the high-pressure cleaning appliance 10 than the first trough portion 84, and it comprises a wall portion 92 as an integral part of the bottom wall 74, said wall portion 92 as it were forming a larger "arch" than the wall portion 86. In the transverse direction of the high-pressure cleaning appliance 10, said trough portion 90 is formed narrow so that beginning from the wall portion 78, it extends approximately up to a fifth of the distance of the edge 71 from the edge 72.

A third trough portion 94 forms a narrow transition region between the first trough portion 84 and the second trough portion 90. It is formed less wide and less deep than the trough portions 84 and 90 and comprises a lattice-like wall portion 96 as an integral part of the bottom wall 74 with a plurality of through-openings 98.

In the region of the three trough portions 84, 90 and 94, the trough 82 has a semicircular configuration. In this manner, the chassis 20 forms, between the wall portions 76 and 78, a trough-shaped first half-shell 100 of a half-shell housing 102 of the high-pressure cleaning appliance 10. A second half-shell 104 of the half-shell housing 102, which interacts with the first half-shell 100, is addressed below.

Figure 3:
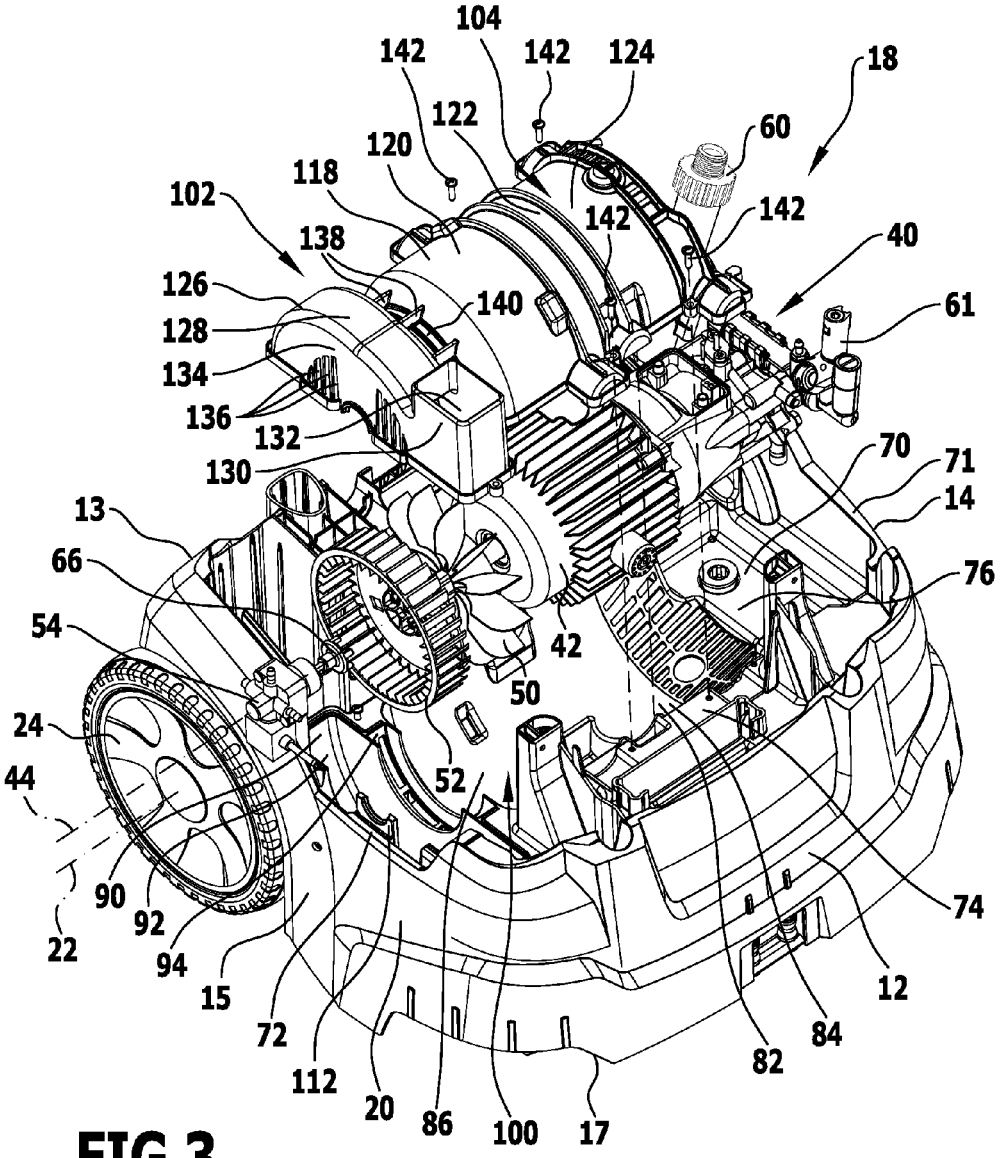
FIG. 3 shows a perspective view of a bottom part of the high-pressure cleaning appliance of FIG. 1, partially in an exploded view, comprising a chassis forming a lower half-shell for accommodating the assembly, the assembly, and an upper half-shell covering the assembly.
Figure 7:
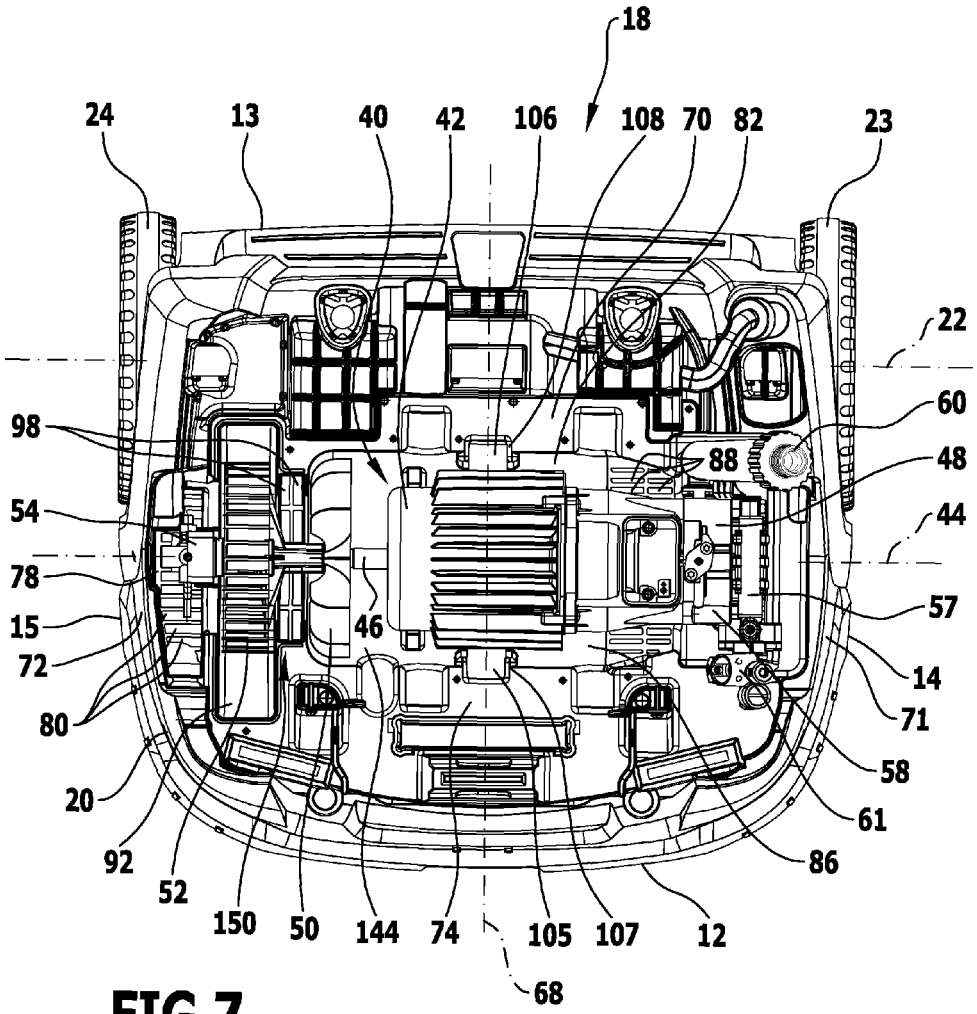
FIG. 7 shows the bottom part of FIG. 6 after removing the upper half-shell.

In the half-chamber delimited on the lower side by the first half-shell 100, the assembly 40 can be inserted for the putting-together of the high-pressure cleaning appliance 10, as becomes in particular apparent from the FIGS. 3 and 7. The assembly 40 can be inserted into the first half-shell 100 in such a manner that the drive axis 44 having a horizontal alignment is aligned parallel to the axis 22 of rotation and perpendicular to the longitudinal center axis 68. On the motor 42, projections 105 and 106 are provided in the form of molded pins. They can engage in semicircular recesses 107 and 108, respectively, which are associated with them and are formed on the first trough portion 84 in the region of the longitudinal center axis 68. Thereby, the possibility is given to fix the assembly 40 relative to the first half-shell 100 and therefore also relative to the half-shell housing 102 in the axial and radial direction with regard to the "proper" alignment of the drive axis 44. By means of two support elements 109 and 110 on the pump head 57, the assembly 40 can also be supported on the wall portion 76.

A further support on the chassis 20 is provided for the assembly 40 in that between the wall portion 78 and the second trough portion 90, a holding element 112 of the half-shell 100 positively engages in a gap-shaped receptacle 114 on the fuel pump 54. This effects an axial and radial fixation of the fuel pump 54 and therefore also of the assembly 40 relative to the first half-shell 100 with regard to the "proper" alignment of the drive axis 44.

Once the assembly 40 is inserted into the first half-shell 100, it takes its position as in illustrated in FIG. 7. In each case half of the motor 42 and the fan 50 is disposed in the first trough portion 84, and half of the blower wheel 52 is disposed in the second trough portion 90. The pump unit 48 is disposed in a chamber above the wall portion 76, and the fuel pump 54 is disposed in a chamber above the wall portion 78.

Figure 4:
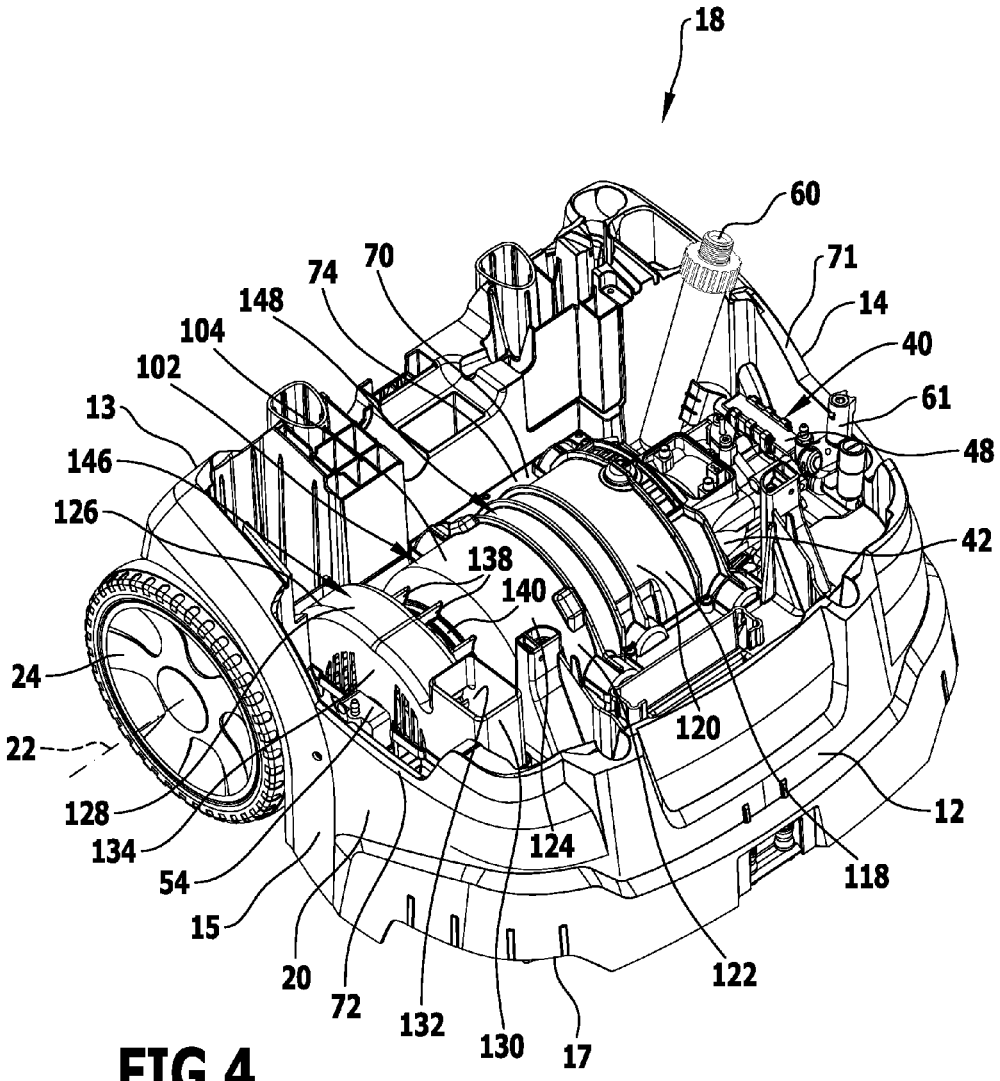
FIG. 4 shows the bottom part of the high-pressure cleaning appliance of FIG. 3 in the assembled state.
Figure 5:
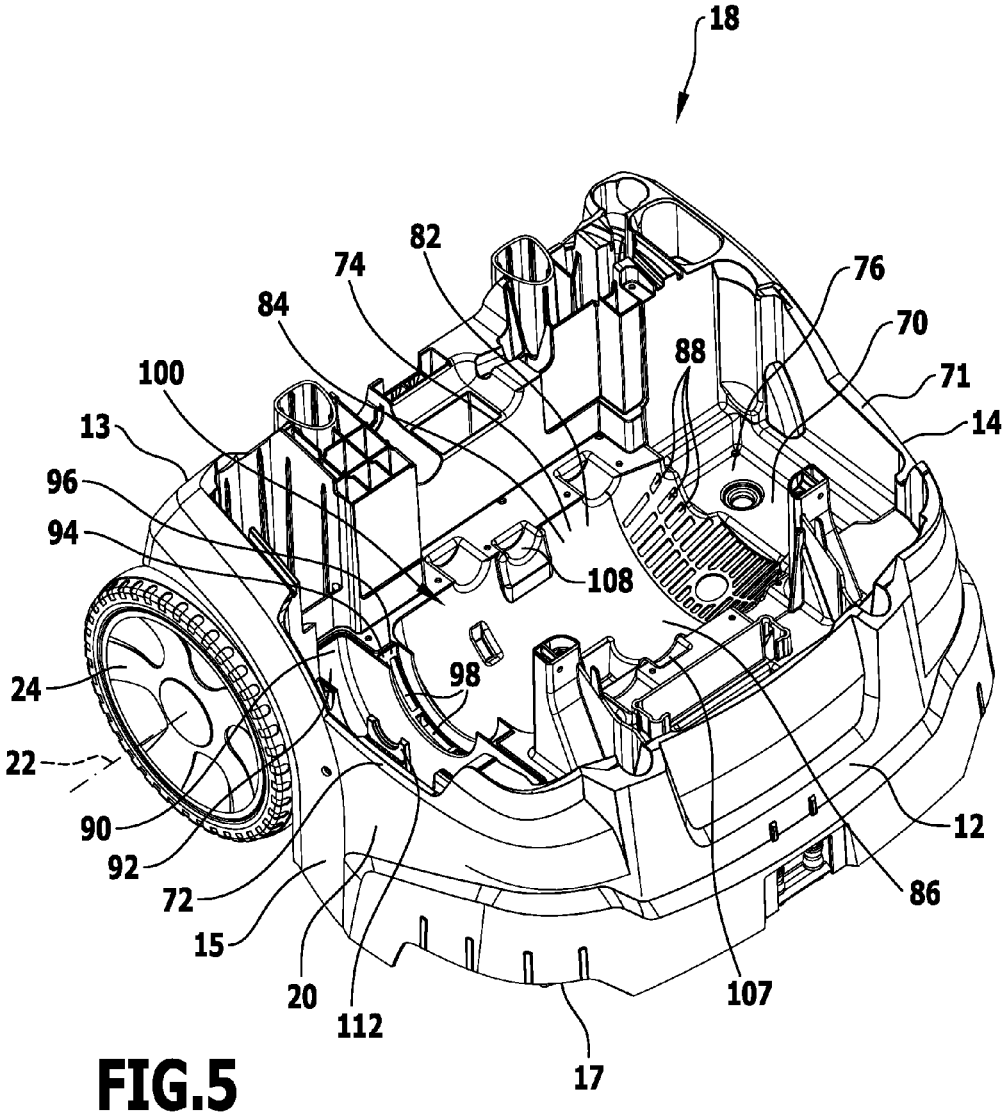
FIG. 5 shows the bottom part of the high pressure cleaning appliance of FIG. 3 without the assembly and without the upper half-shell.
Figure 6:
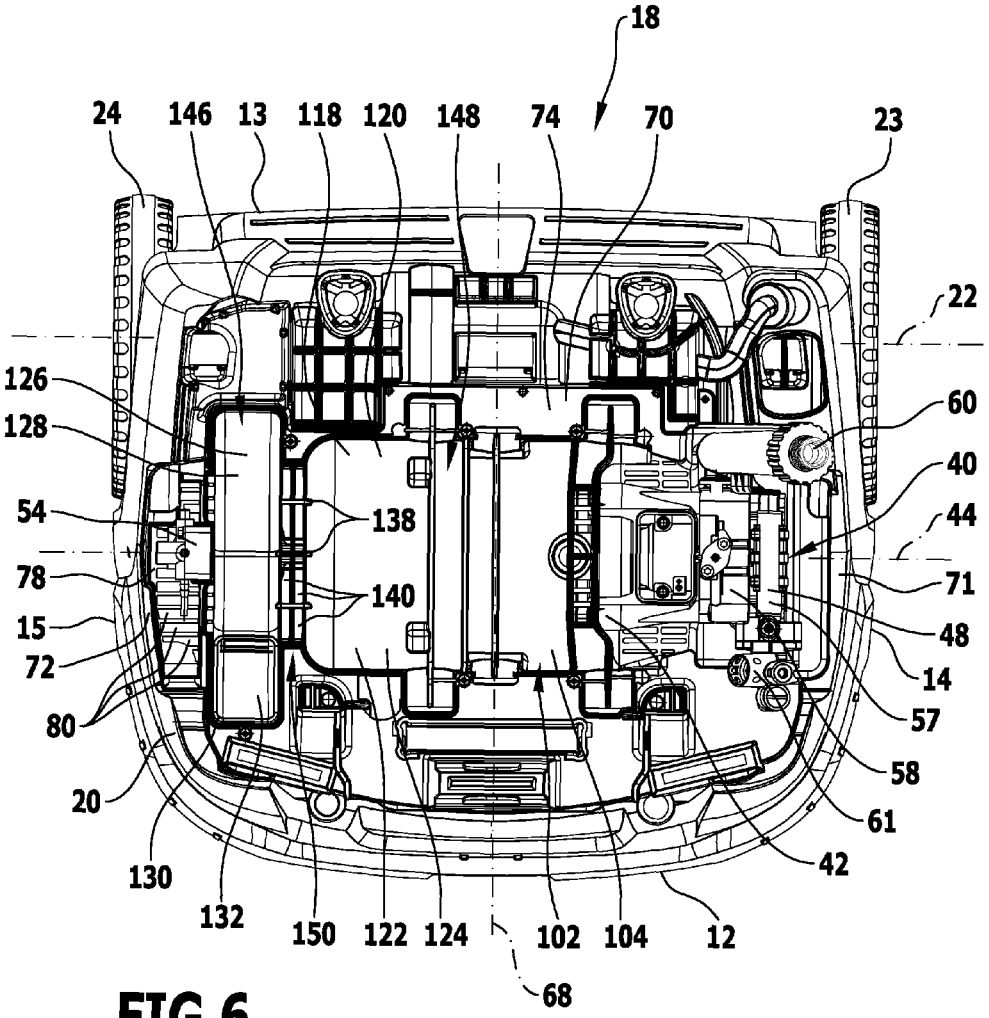
FIG. 6 shows a top view of the bottom part of FIG. 3 in the assembled state.

The already-mentioned second half-shell 104 of the half-shell housing 102 is, with regard to manufacturing, formed cost-effective and in a simple manner as a single-piece plastics molding. It is substantially configured in the form of a trough turned upside down and forms a cover 118 in order to partially cover the assembly 40 inserted into the first half-shell 100 (FIGS. 3, 4 and 6). The second half-shell 104 is formed complementary to the first half-shell 100, the cover 118 comprising an arch-shaped and substantially semicircular cover wall 120.

The cover 118 has a first cover portion 122 which is formed complementary to the first trough portion 84. By means of a wall portion 124 of the cover wall 120, the first cover portion 122 is able to cover the assembly 40 in the axial direction from the fan 50 approximately to the middle of the motor 42. This means that approximately a half of the motor 42, facing toward the pump unit 48, is not covered by the first cover portion 122. In this manner, the unit 56 formed of the motor 42 and the pump unit 48 passes in the axial direction of the drive axis 44 through an opening of the half-shell housing 102 which, on its front end facing toward the left side 14, is configured to be open.

Moreover, the cover 118 has a second cover portion 126 which is configured complementary to the second trough portion 90 and comprises a wall portion 128 as an integral part of the cover wall 120. The wall portion 128 is able to overlap the blower wheel 52. The second cover portion 126 forms, facing toward the front side 12, a connecting element 130 with an outlet opening 132 for combustion air delivered by the blower wheel 52. A combustion air channel, which is not illustrated in the drawing, can be connected to the connecting element 130, so as to feed combustion air to the heat exchanger 28.

At the end, facing toward the right side 15, the second cover portion 126 has a wall 134 which is oriented transverse to the drive axis 44 and has a plurality of through-openings 136. The wall 134 can also engage in the gap-shaped receptacle 114 on the fuel pump 54 and in this manner can fix the assembly 40 together with the holding element 112.

The carrier disk 62 of the blower wheel 52 closes the chamber formed by the second trough portion 90 and the second cover portion 126 for the blower wheel 52 in the axial direction toward the chamber region formed above the third trough portion 94.

The first cover portion 122 is connected to the second cover portion 126 via a plurality of webs 138 which, with regard to the drive axis 44, extend radially and run parallel to said axis. The webs 138 are disposed in this manner above the third trough portion 94. A separate portion of the cover wall 122 does not exist in this region. Between the webs 138, a plurality of inlet openings 140 are formed for air sucked in by the fan 50.

Apart from this, the cover 118 also forms two semicircular recesses which, together with the already mentioned recesses 107 and 108, interact for fixing the projections 105 and 106 and therefore the assembly 40 to the half-shell housing 102.

Securing the second half-shell 104 and the first half-shell 100 is carried out in the present case by four fasteners only, in the form of screws 142 which penetrate through the first cover portion 122 and are anchored on the chassis 20 (FIG. 3).

As the above description shows, the use of the half-shell housing 102 with the two half-shells 100 and 104 enables a compact structure of the high-pressure cleaning appliance 10 and facilitates the mounting of the assembly 40 on the high-pressure cleaning appliance 10 as well as making its maintenance easier. Here, the pump unit 48 and the fuel pump 54 are not accommodated in the accommodating chamber 144 (shown in FIG. 7 as a half-chamber) formed between the half-shells 100 and 104, but they are disposed outside the half-shell housing 102. Since during maintenance of the high-pressure cleaning appliance 10, it is sometimes necessary to carry out work on the pump unit 48 and/or on the fuel pump 54, the pump unit 48 and the fuel pump 54 can be accessed in this manner by a user. It is in particular not required to detach the second half-shell 104 from the first half-shell 100 in order to perform such maintenance. Furthermore, the half-shell housing 102 forms an effective protection for the blower wheel 52, the fan 50, and the motor 42 half facing toward the fan 50 against external influences and direct access by a user. There is only little need, up to no need, for maintenance on these components so that opening the half-shell housing 102 needs to be carried out only very rarely.

In an implementation of the high-pressure cleaning appliance 10, it has proven to be advantageous that by virtue of the above-described configuration of the half-shell housing 102, two housing portions are as it were formed which are axially spaced apart from one another, namely a fan housing 146 for the blower wheel 52 and a flow channel 148 for the fan 50 and the motor 42 (FIG. 6).

The fan housing 146 is substantially delimited by the wall portions 92 and 126, the wall 134, the connecting element 130, and the carrier disk 62 of the blower wheel 52. Combustion air for the heat exchanger 28 can be sucked in, on the one hand, from the interior of the high-pressure cleaning appliance 10, below the hood 32, and also through the through-openings 80 of the wall portion 78 from the atmosphere. This ensures that fresh air from the atmosphere is at least partially fed to the heat exchanger 28, which has proven in practice to be advantageous for the operation of the same. Air sucked in by the blower wheel 52 can pass, for example, through the cutouts 136 of the wall 134 or can flow past the holding element 112, and the combustion air flow, as already mentioned, can discharge via the outlet opening 132 from the fan housing 146. The carrier disk 62 provides a degree of sealing of the fan housing 146 in the axial direction with regard to the drive axis 44.

To ensure that the fan 50 can be provided with sufficient air for cooling the motor 42, the half-shell housing 102 comprises the third trough portion 94 and the cover 118 portion corresponding thereto so that between the blower wheel 52 and the fan 50, an intermediate space 150 is formed. Cooling air sucked in by the fan 50 can enter the half-shell housing 102, on the one hand, through the through-openings 98 of the wall portion 96 from the atmosphere and, on the other hand, from the interior of the high-pressure cleaning appliance 10, below the hood 32, through the inlet openings 140 between the webs 138. Also in this case, it is ensured that fresh air from the atmosphere is fed to the air sucked in by the fan 50. It has been found that thereby a cooling air flow for the motor 42 can be provided in an effective manner so that overheating of the same can be avoided.

In the region of the first trough portion 84 and the first cover portion 122, the contour of the half-shell housing 102 follows the outer contour of the fan 50 and the motor 42 so that the half-shell housing 102 in this region forms the already mentioned flow channel 148 for the cooling air flow to be generated by the fan 50. Because the half-shell housing 102 is open on its end face facing the left side 14, cooling air can discharge from the half-shell housing 102. By virtue of the through-openings 88 of the wall portion 86, it is ensured that at least a portion of the cooling air escapes into the atmosphere. Thereby, heat accumulation in the flow channel 148 and inside the high-pressure cleaning appliance 10, underneath the hood 32, can be effectively avoided.

Apart from that, the arrangement of the assembly 40 having a horizontal drive axis 44 below the heat exchanger 28 facilitates the very compact design of the high-pressure cleaning appliance 10 having a heatable heat exchanger 28.

The invention claimed is:

1. A high-pressure cleaning appliance, comprising:

a heatable heat exchanger for heating a liquid that is dischargeable by the high-pressure cleaning appliance, a motor having a drive shaft that defines a drive axis, a pump unit for increasing a liquid pressure, a blower wheel for generating a combustion air flow, a fuel pump for delivering a fuel for the heat exchanger, the pump unit, the blower wheel and the fuel pump being disposed along the drive axis and being drivable by the drive shaft and forming an assembly together with the motor, and a housing having a first half-shell and a second half-shell which between them define an accommodating chamber in which the assembly is at least partially accommodated, wherein the pump unit is at least partially disposed outside of the housing.

2. The high-pressure cleaning appliance according to claim 1, further comprising, as a component part of the assembly, a fan that is disposed along the drive axis and is drivable by the drive shaft, for generating a cooling air flow that cools the motor.

3. The high-pressure cleaning appliance according to claim 2, wherein the fan is formed as an axial fan held on the drive shaft and, with regard to the drive axis, is disposed axially upstream of the motor.

4. The high-pressure cleaning appliance according to claim 2, wherein the fan and the motor are at least partially disposed in the accommodating chamber.

5. The high-pressure cleaning appliance according to claim 4, wherein, in a region of the fan and the motor, the housing forms a flow channel, and, in the housing, at least one inlet opening for air sucked in by the fan is formed axially upstream of the fan with regard to the drive axis, and at least one outlet opening for the cooling air flow is formed axially downstream of the fan.

6. The high-pressure cleaning appliance according to claim 1, wherein the pump unit forms, in an axial direction with regard to the drive axis, a first end of the assembly.

7. The high-pressure cleaning appliance according to claim 1, wherein the blower wheel is disposed in the accommodating chamber.

8. The high-pressure cleaning appliance according to claim 7, wherein, in the housing, at least one of at least one inlet opening for air sucked in by the blower wheel is formed axially upstream of the blower wheel with regard to the drive axis, and at least one outlet opening for the combustion air flow is formed.

9. The high-pressure cleaning appliance according to claim 8, wherein the housing forms a connecting element for a combustion air channel which opens out via the at least one outlet opening into the accommodating chamber.

10. The high-pressure cleaning appliance according to claim 1, wherein the blower wheel is formed as a radial fan which is held on the drive shaft and is disposed, in an axial direction with regard to the drive axis, on a side, facing away from the motor, of a fan associated with the motor.

11. The high-pressure cleaning appliance according to claim 10, wherein between the blower wheel and the fan, in the axial direction with regard to the drive axis, an intermediate space is formed which is delimited in a circumferential direction of the drive axis by the housing and into which air sucked in by the fan enters through a plurality of inlet openings formed in the housing in the circumferential direction of the drive axis.

12. The high-pressure cleaning appliance according to claim 1, wherein an intermediate wall oriented transverse to the drive axis divides the accommodating chamber with regard to the drive axis axially into a first chamber region in which the combustion air flow is generated and into a second chamber region in which a cooling air flow is generated that cools the motor.

13. The high-pressure cleaning appliance according to claim 12, wherein the intermediate wall is formed by the blower wheel.

14. The high-pressure cleaning appliance according to claim 1, wherein the fuel pump is disposed outside of the housing.

15. The high-pressure cleaning appliance according to claim 1, wherein, in an axial direction with regard to the drive axis, the fuel pump forms a second end of the assembly.

16. The high-pressure cleaning appliance according to claim 1, wherein the housing has a holding element which is aligned transverse to the drive axis and on which the fuel pump is held with regard to the drive axis in at least one of an axial and a radial direction.

17. The high pressure cleaning appliance according to claim 1, wherein the housing is configured in a barrel-shaped manner and at least one of the first half-shell and the second half-shell are at least partially trough-shaped.

18. The high-pressure cleaning appliance according to claim 1, wherein at least one of the first half-shell and the second half-shell is made in one piece.

19. The high-pressure cleaning appliance according to claim 1, further comprising a chassis which forms at least one of the first half-shell and the second half-shell.

20. The high-pressure cleaning appliance according to claim 1, wherein at least one of the first half-shell and the second half-shell is made from a plastics material.

* * * * *